US008814615B2

(12) United States Patent
Kuriyagawa et al.

(10) Patent No.: US 8,814,615 B2
(45) Date of Patent: Aug. 26, 2014

(54) OUTBOARD MOTOR

(71) Applicant: Honda Motor Co., Ltd., Tokyo (JP)

(72) Inventors: Koji Kuriyagawa, Wako (JP); Norikazu Shimizu, Wako (JP); Hikaru Ikeda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 114 days.

(21) Appl. No.: 13/670,537

(22) Filed: Nov. 7, 2012

(65) Prior Publication Data

US 2013/0130573 A1 May 23, 2013

(30) Foreign Application Priority Data

Nov. 22, 2011 (JP) ..... 2011-255442

(51) Int. Cl.
*B60L 1/14* (2006.01)
*B63H 20/00* (2006.01)

(52) U.S. Cl.
CPC ..... *B63H 20/00* (2013.01)
USPC ..... 440/2; 440/88 L

(58) Field of Classification Search
USPC ..... 440/1, 2, 52, 88 L, 88 R; 123/195 P, 123/196 W
See application file for complete search history.

(56) References Cited

U.S. PATENT DOCUMENTS 5,501,621 A * 3/1996 Shigedomi et al. ..... 440/88 R
5,613,470 A * 3/1997 Shiomi et al. ..... 123/195 P
5,730,632 A * 3/1998 Murata et al. ..... 440/88 R
6,126,499 A * 10/2000 Katayama et al. ..... 440/88 R

FOREIGN PATENT DOCUMENTS

JP 6-033730 A 2/1994

* cited by examiner

*Primary Examiner* — Lars A Olson
(74) *Attorney, Agent, or Firm* — Carrier Blackman & Associates, P.C.; Joseph P. Carrier; William D. Blackman

(57) ABSTRACT

In an outboard motor having a prime mover, a gear mechanism transmitting a driving force of the prime mover to a propeller, and a gear case housing the gear mechanism, it is configured to have a drain bolt fastened to a drain hole bored at the gear case and constituted as a magnetic member; a stacked portion provided at an exposed part of the drain bolt in an inside of the gear case and having a conductor, an insulator and a resistive element partially making contact with the conductor that are stacked in a gravitational direction; a current detector detecting a current value conducted from the conductor to the drain bolt under a condition where voltage is applied to the conductor; and a wear debris amount detector adapted to detect an amount of wear debris of the gear mechanism deposited at the drain bolt based on the conducted current value.

8 Claims, 6 Drawing Sheets

OUTBOARD MOTOR

BACKGROUND

1. Technical Field

An embodiment of the invention relates to an outboard motor, particularly to an outboard motor that can detect wear debris of a gear mechanism.

2. Background Art

Conventionally, there is widely known an outboard motor in which a driving force of a prime mover such as an internal combustion engine is transmitted to a propeller through a gear mechanism. When the driving force is transmitted, gears of the gear mechanism are rubbed against each other so that they are worn, sometimes resulting in wear debris (i.e., metal powder, etc.). In the case where such wear debris is generated, it may be caught in the gear mechanism as obstacles and it possibly damages the gear mechanism, disadvantageously.

To cope with it, in Japanese Laid-Open Patent Application No. Hei 6 (1994)-33730 (730), a branch passage used to circulate oil (lubricating oil) is connected to a gear case housing the gear mechanism and the branch passage is installed with a detecting section that detects an amount of wear debris based on the degree of transparency of the oil. It makes possible to, for example, carry out the maintenance such as oil change at the time when the increase in the amount of the wear debris is detected, thereby preventing occurrence of the aforesaid defect.

SUMMARY

However, when it is configured to provide the branch passage and detecting section as taught in the reference, it causes a larger outboard motor and complex structure, disadvantageously.

An object of an embodiment of this invention is therefore to overcome the foregoing problem by providing an outboard motor that can detect an amount of wear debris of a gear mechanism without making the structure larger and more complex, thereby preventing the gear mechanism from being damaged by the wear debris.

In order to achieve the object, the embodiment of the invention provides in the first aspect an outboard motor having a prime mover, a gear mechanism adapted to transmit a driving force of the prime mover to a propeller, and a gear case housing the gear mechanism, comprising: a drain bolt adapted to be fastened to a drain hole bored at the gear case, the drain bolt being constituted as a magnetic member; a stacked portion provided at an exposed part of the drain bolt in an inside of the gear case and having a conductor, an insulator and a resistive element partially making contact with the conductor that are stacked in a gravitational direction; a current detector adapted to detect a conducted current value conducted from the conductor to the drain bolt under a condition where voltage is applied to the conductor; and a wear debris amount detector adapted to detect an amount of wear debris of the gear mechanism deposited at the drain bolt based on the detected conducted current value.

In order to achieve the object, the embodiment of the invention provides in the second aspect a method of detecting wear debris of a gear mechanism adapted to transmit a driving force of a prime mover to a propeller of an outboard motor having a gear case housing the gear mechanism, a drain bolt adapted to be fastened to a drain hole bored at the gear case, the drain bolt being constituted as a magnetic member, and a stacked portion provided at an exposed part of the drain bolt in an inside of the gear case and having a conductor, an insulator and a resistive element partially making contact with the conductor that are stacked in a gravitational direction, comprising the steps of: detecting a conducted current value conducted from the conductor to the drain bolt under a condition where voltage is applied to the conductor; and detecting an amount of wear debris of the gear mechanism deposited at the drain bolt based on the detected conducted current value.

BRIEF DESCRIPTION OF DRAWINGS

The above and other objects and advantages of an embodiment of the invention will be more apparent from the following description and drawings in which.

DESCRIPTION OF EMBODIMENT

An outboard motor according to an embodiment of the present invention will now be explained with reference to the attached drawings.

Figure 1:
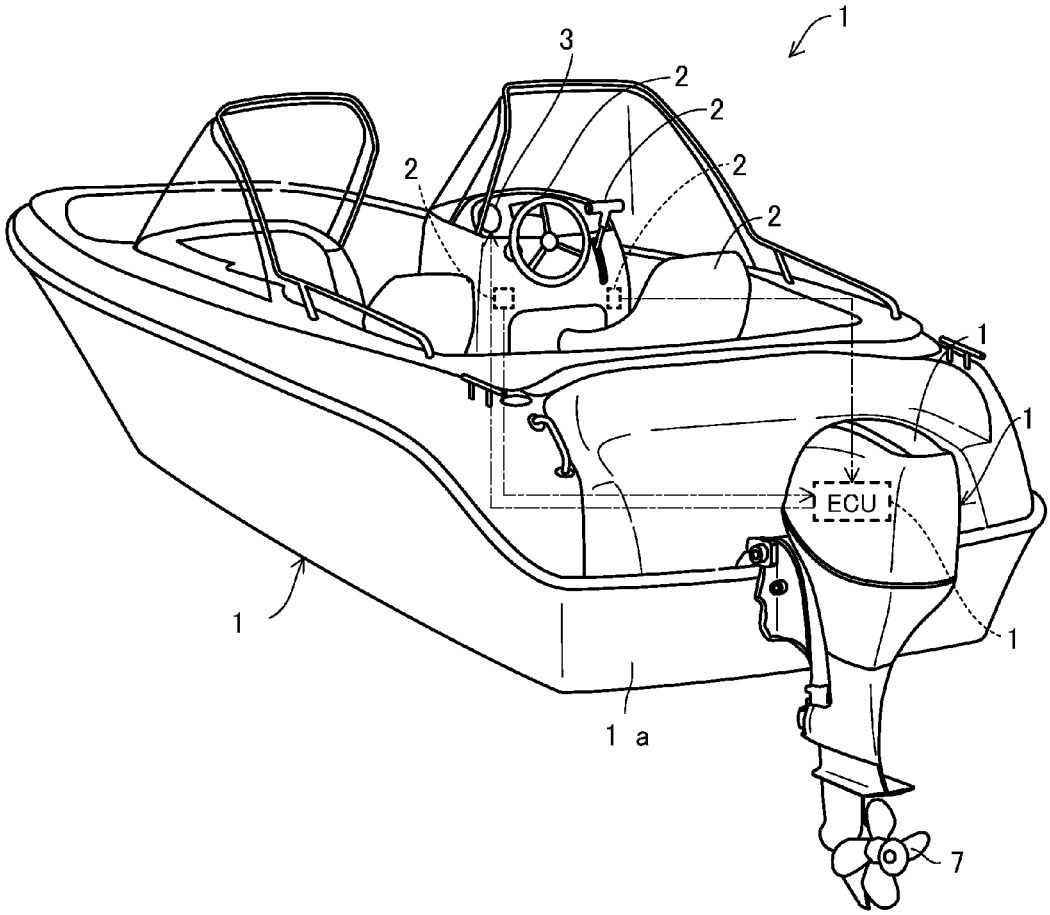
FIG. 1 is an overall schematic view of an outboard motor including a boat (hull) according to an embodiment of the invention.

FIG. 1 is an overall schematic view of an outboard motor including a boat (hull) according to an embodiment of the invention.

In FIG. 1, symbol 1 indicates the boat or vessel whose hull 12 is mounted with the outboard motor 10. As illustrated, the outboard motor 10 is clamped (fastened) to the stern or transom 12*a* of the hull 12.

The outboard motor 10 has an internal combustion engine (prime mover; not shown in FIG. 1) and an engine cover 14 that covers the engine. The engine cover 14 is installed in its interior space (which is an engine room) with an Electronic Control Unit (ECU) 16 in addition to the engine. The ECU 16 has a microcomputer including a CPU, ROM, RAM and other devices and controls the operation of the outboard motor 10.

A steering wheel 22 is installed near a cockpit (operator's seat) 20 of the hull 12 to be rotatably manipulated by the operator (not shown). A steering angle sensor 24 is attached on a shaft (not shown) of the steering wheel 22 to produce an output or signal corresponding to the steering angle applied or inputted by the operator through the steering wheel 22.

A shift lever (shift/throttle lever) 26 is provided near the cockpit 20 to be manipulated by the operator. The shift lever 26 can be moved or swung in the front-back direction from the initial position and is used by the operator to input a shift change command (forward, reverse and neutral switch command) and an engine speed regulation command. A lever position sensor 28 is installed near the shift lever 26 and produces an output or signal corresponding to a position of the shift lever 26. The outputs of the sensors 24, 28 are sent to the ECU 16.

A dashboard of the cockpit 20 is installed with a display (monitor (meter); informer) 30 used to inform the operator of the fact that an amount of wear debris of a gear mechanism exceeds a permissible range when it so-determined, as will be explained later.

Figure 2:
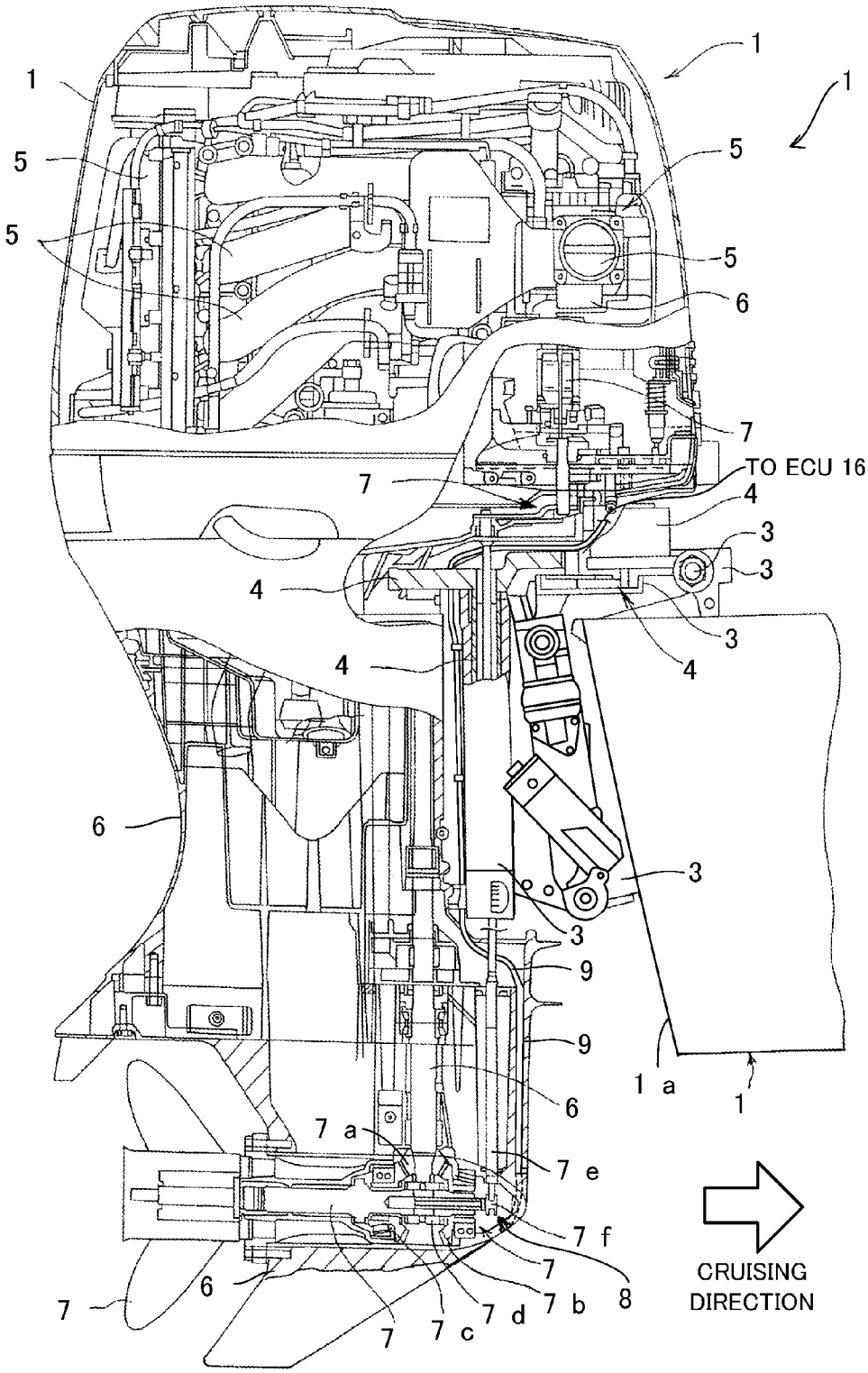
FIG. 2 is an enlarged sectional side view partially showing the outboard motor shown in FIG. 1.
Figure 3:
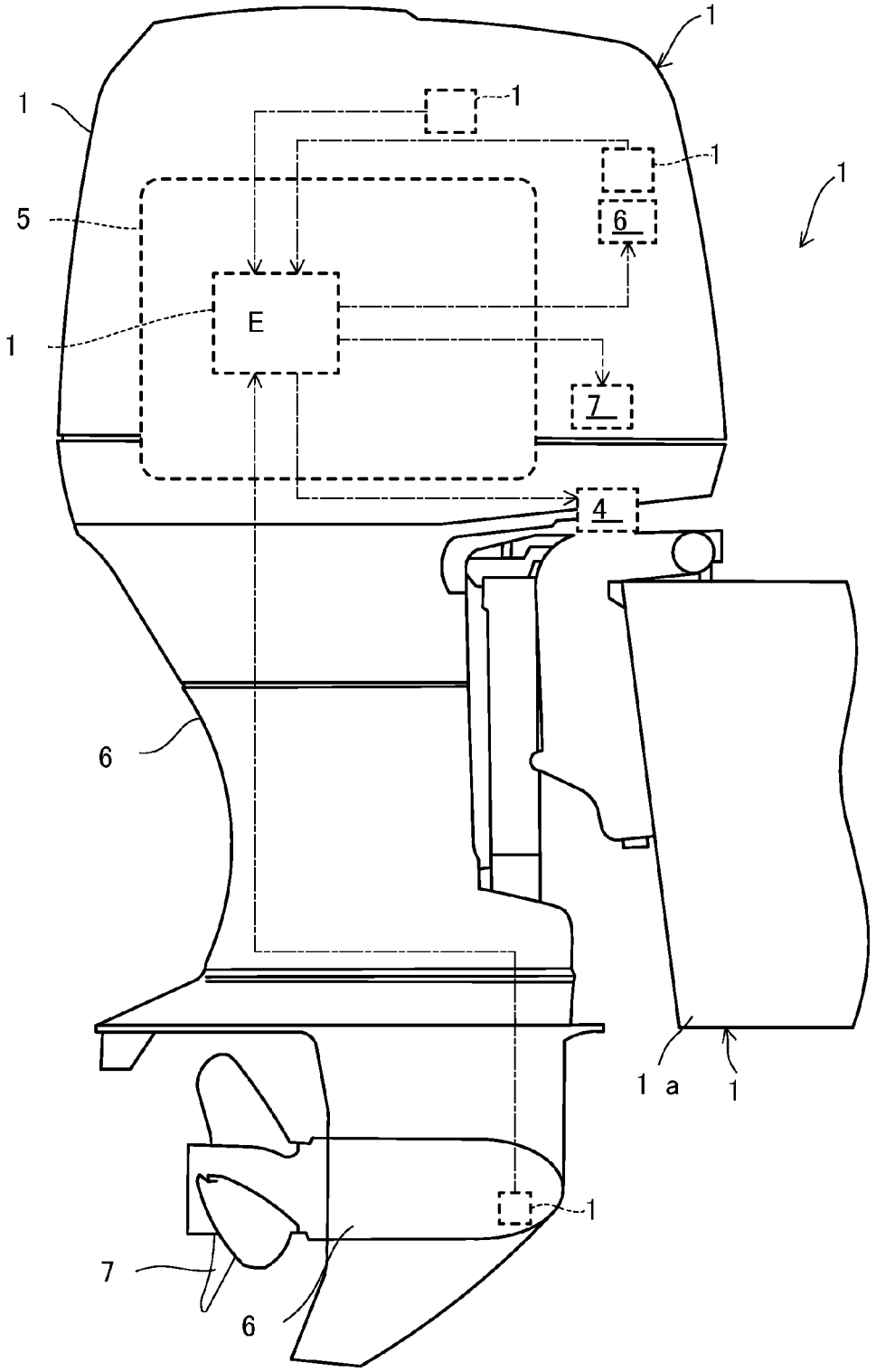
FIG. 3 is an enlarged side view of the outboard motor shown in FIG. 1.

FIG. 2 is an enlarged sectional side view partially showing the outboard motor shown in FIG. 1 and FIG. 3 is an enlarged side view of the outboard motor shown in FIG. 1.

As clearly shown in FIG. 2, the outboard motor 10 is fastened to the hull 12 through a swivel case 32, tilting shaft 34 and stern brackets 36.

An electric steering motor (actuator) 42 for driving a swivel shaft 40 which is housed in the swivel case 32 to be rotatable about the vertical axis, is installed near the swivel case 32. The rotational output of the steering motor 42 is transmitted to the swivel shaft 40 via a speed reduction gear mechanism 44 and mount frame 46, whereby the outboard motor 10 is rotated or steered in the lateral direction about the swivel shaft 40 serving as a steering axis (about the vertical axis).

The outboard motor 10 is installed at its upper portion with the aforesaid engine (now assigned by symbol 50). The engine 50 comprises a spark-ignition, water-cooled, gasoline engine with a displacement of 2,200 cc. The engine 50 is located above the water surface.

An air intake pipe 52 of the engine 50 is connected to a throttle body 54. The throttle body 54 has a throttle valve 56 installed therein and an electric throttle motor (actuator) 60 for opening and closing the throttle valve 56 is integrally disposed thereto.

The output shaft of the throttle motor 60 is connected to the throttle valve 56 via a speed reduction gear mechanism (not shown). The throttle motor 60 is operated to open and close the throttle valve 56, thereby regulating a flow rate of air sucked in the engine 50 to control the engine speed.

The engine cover 14 covering the engine 50 is attached at its bottom (in the gravitational direction) with an extension case 62, and the extension case 62 is attached at its bottom with a gear case 64.

A drive shaft 66 that is rotatably supported in parallel with the vertical axis is installed in the extension case 62 and gear case 64. An upper end of the drive shaft 66 is connected to the crankshaft (not shown) of the engine 50 and a lower end thereof is connected through a gear mechanism (shift mechanism) 70 to a propeller shaft 72 that is rotatably supported in parallel with the horizontal axis.

One end of the propeller shaft 72 is attached with a propeller 74. The gear mechanism 70 includes a pinion gear 70*a* installed at a lower end of the drive shaft 66, a forward bevel gear 70*b* and reverse bevel gear 70*c* that are engaged (meshed) with the pinion gear 70*a* to be rotated thereby in the opposite directions, a clutch 70*d* used to engage the propeller shaft 72 to either the forward bevel gear 70*b* or the reverse bevel gear 70*c*, and the like.

An electric shift motor (actuator) 76 that operates the gear mechanism 70 to change a shift position is installed in the engine cover 14. Note that the outboard motor 10 is equipped with a power source (not shown) such as a battery attached to the engine 50 to supply operating power to the motors 42, 60, 76, etc.

An output shaft of the shift motor 76 is connected to an upper end of a shift rod 70*e* of the gear mechanism 70 through a speed reduction gear mechanism 78. Consequently, when the shift motor 76 is operated, the shift rod 70*e* and a shift slider 70*f* are appropriately displaced to operate the clutch 70*d*, thereby changing or switching the shift position among the forward, reverse and neutral positions.

When the gear mechanism 70 is in the forward or reverse position, the rotation of the drive shaft 66 (i.e., the driving force of the engine 50) is transmitted to the propeller shaft 72 through the gear mechanism 70, so that the propeller 74 is rotated to generate thrust acting in the direction of making the hull 12 move forward or backward.

Thus, the gear mechanism 70 transmits the driving force of the engine 50 to the propeller 74 and is housed in the gear case 64.

The inner space of the gear case 64 stores oil (lubricating oil) used for the gear mechanism 70 (i.e., the inner space is filled with the oil) for lubricating rotating portions of the gear mechanism 70 such as the pinion gear 70*a*, forward and reverse bevel gears 70*b*, 70*c*, etc.

Figure 4:
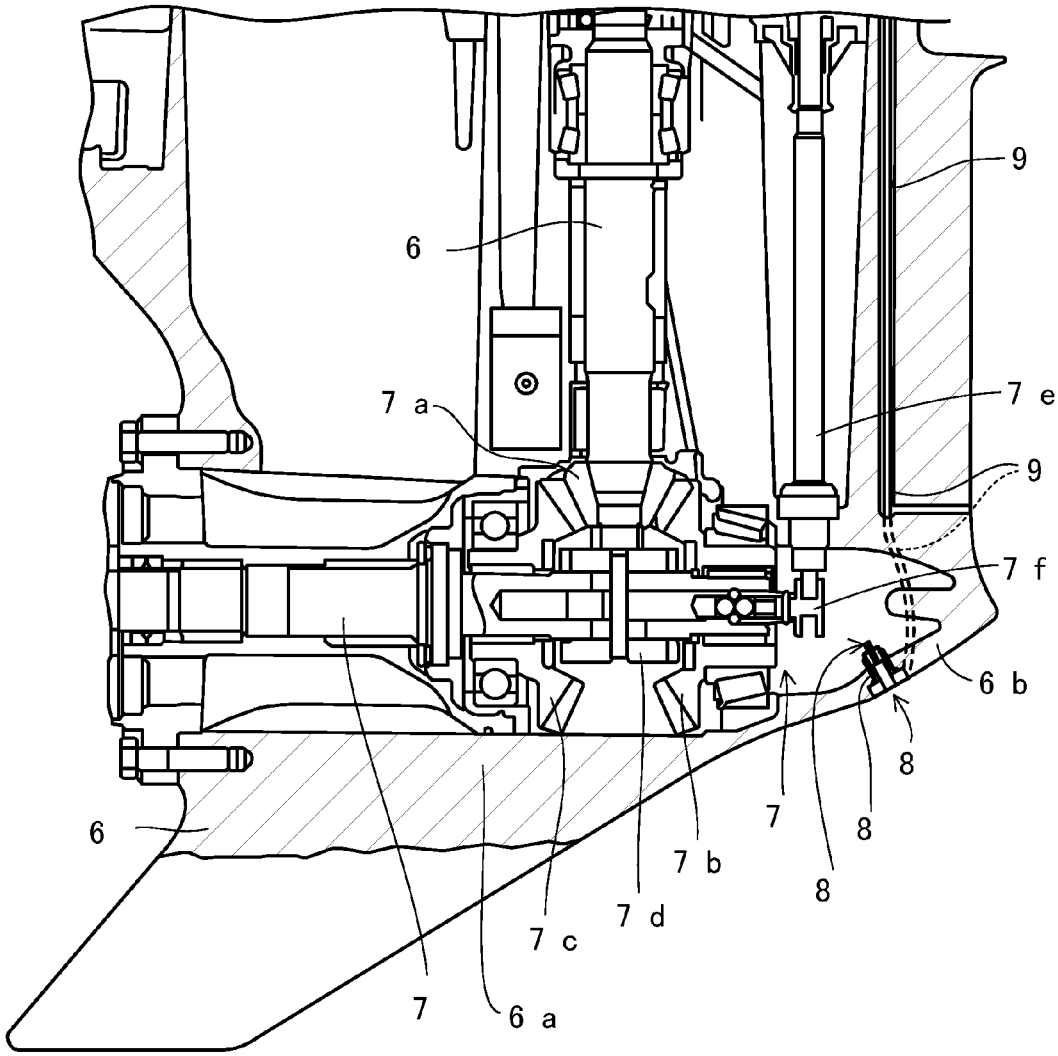
FIG. 4 is an enlarged sectional side view partially showing a gear case shown in FIG. 2 and thereabout.

FIG. 4 is an enlarged sectional side view partially showing the gear case 64 shown in FIG. 2 and thereabout.

As shown in FIG. 4, etc., the gear case 64 accommodates a large part of the gear mechanism 70 and includes a cylindrical portion 64*a* having a cylindrical shape and a tapered portion 64*b* that is continuously formed with the cylindrical portion 64*a* and whose diameter is gradually reduced toward the end on the front side (in the cruising direction).

The bottom of the gear case 64 (more precisely, the bottom of the tapered portion 64*b* of the gear case 64) is bored with a drain hole 80 used for draining or discharging the oil at oil change. The drain hole 80 has an internal thread to be formed as a female screw, and a drain bolt 82 is inserted therein so that the drain bolt 82 can open and close the drain hole 80.

The drain hole 80 and drain bolt 82 are provided at the gear case 64 at a position where wear debris of the gear mechanism 70 is most adsorbed (or settled). Specifically, the oil in the gear case 64 is to be stirred by the operation of the gear mechanism 70, and the drain hole 80 and drain bolt 82 are provided at a position that is slightly away from the gear mechanism 70 and does not greatly affected by such stir, i.e., a position where the oil is not greatly flown.

Figure 5:
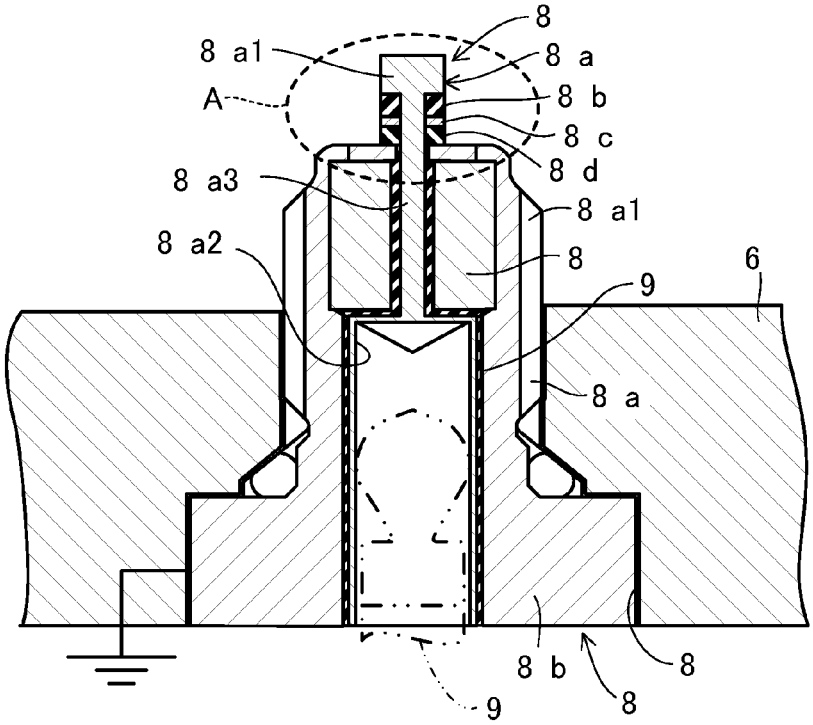
FIG. 5 is an enlarged sectional view of a drain bolt shown in FIG. 4, etc.
Figure 6:
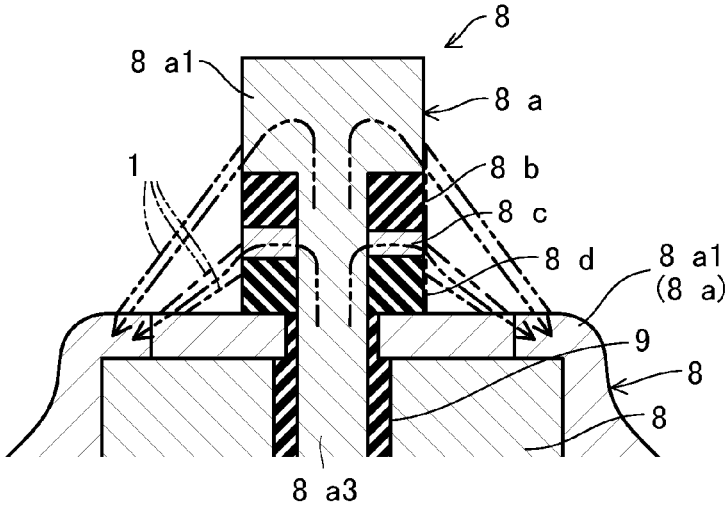
FIG. 6 is a further-enlarged sectional view showing a region surrounded by a dashed line A of FIG. 5.

FIG. 5 is an enlarged sectional view of the drain bolt shown 82 in FIG. 4, etc. and FIG. 6 is a further-enlarged sectional view showing a region surrounded by a dashed line A of FIG. 5.

As shown in FIG. 5, the drain bolt 82 includes a screw portion 82*a* that has an external thread to be formed as a male screw and a head portion 82*b* that is continuously formed with the screw portion 82*a* and larger in diameter than the screw portion 82*a*. The drain bolt 82 is made of a material that is able to be magnetized, such as steel.

The drain bolt 82 is designed so that, when being fastened with the drain hole 80, a part of the drain bolt 82, i.e., a tip of the screw portion 82*a* is exposed in the internal space (in the chamber filled with the oil) of the gear case 64. In FIGS. 5 and 6, an exposed part of the drain bolt 82 is indicated by 82*a*1.

The inside of the exposed part 82*a*1 of the drain bolt 82 is provided with a magnetic member 84 such as a permanent magnet. Consequently, the entire drain bolt 82 is magnetized, in other words, the drain bolt 82 is constituted as a magnetic member.

As clearly shown in FIG. 6, the exposed part 82*a*1 of the drain bolt 82 is provided with a stacked portion 86 in which a conductor 86*a*, a first insulator (insulator) 86*b*, a resistive element 86*c* that partially makes contact with the conductor 86*a*, and a second insulator 86*d* are stacked in the gravitational direction.

The conductor 86*a* comprises a metal member. As clearly shown in FIG. 5, a part of the conductor 86*a* is positioned in the inside of the drain bolt 82 and one end thereof projects from the exposed part 82*a*1. More specifically, the conductor 86*a* includes an exposed portion 86*a*1 exposed in the internal space of the gear case 64, a harness connector 86*a*2 that is provided in the inside of the drain bolt 82, formed to have a hollow and connectable with a harness (described later), and a connector 86*a*3 that interconnects the exposed portion 86*a*1 and harness connector 86*a*2.

The connector 86*a*3 is smaller in diameter than the exposed portion 86*a*1 and harness connector 86*a*2. One end of the connector 86*a*3 on the side of the exposed portion 86*a*1 projects from the exposed part 82*a*1 and the remaining part thereof is positioned in the inside of the screw portion 82*a* (more precisely, in the vicinity of a place where the magnetic member 84 is installed).

The harness connector 86*a*2 is connected to a harness 90 that is formed with a bullet terminal at its end, as indicated by imaginary lines in the figure. The outer circumference of the harness connector 86*a*2 and connector 86*a*3 is covered by a third insulator 92 so that the harness connector 86*a*2 and connector 86*a*3 of the conductor 86*a* are electrically insulated from the inside of the drain bolt 82.

The resistive element 86*c* is made of, for example, resistive paste and the resistance value thereof is set to 1.2 kΩ, for instance. The first insulator 86*b*, resistive element 86*c* and second insulator 86*d* each have ring-link shapes and are arranged to contact and cover a certain part of the connector 86*a*3 of the conductor 86*a*, the certain part projecting from the exposed part 82*a*1. The exposed portion 86*a*1 of the conductor 86*a*, the first insulator 86*b*, the resistive element 86*c* and the second insulator 86*d* are arranged to be firmly attached with each other.

Thus, the outer circumference of the stacked portion 86 on the lateral side is provided with, in order from the top (in the gravitational direction), the conductor 86*a* (exposed portion 86*a*1), first insulator 86*b*, resistive element 86*c* and second insulator 86*d*.

As shown in FIG. 4, a water tube (pitot tube) 94 used with a boat speed sensor (not shown) is installed at an appropriate position of the gear case 64 on the front side (in the cruising direction). The water tube 94 is connected to the boat speed sensor that detects a boat speed (speed of the hull 12) based on water pressure in the water tube 94.

The harness 90 connected to the harness connector 86*a*2 of the conductor 86*a* is laid so that it follows the shape of the tapered portion 64*b* and then is inserted in the water tube 94. After the water tube 94, the harness 90 extends via the gear case 64 and extension case 62 toward the stern brackets 36, as shown in FIG. 2. The harness 90 is fastened at several points in the stern brackets 36 and then, connected to the ECU 16 in the engine cover 14.

Owing to the above configuration, the harness 90 can be wired from the drain bolt 82 to the ECU 16 without changing the design or shape of the gear case 64, etc., while the harness 90 does not affect the cruising performance of the boat 1 by the outboard motor 10, i.e., the fluid resistance of the gear case 64.

As shown in FIG. 3, a throttle opening sensor 100 is installed near the throttle valve 56 to produce an output or signal indicative of a throttle opening. A crank angle sensor 102 is disposed near the crankshaft of the engine 50 and produces a pulse signal at every predetermined crank angle. Further, a current sensor (current value detector) 104 is installed near the drain bolt 82 to produce an output or signal indicative of a conducting current value γ to be conducted from the conductor 86*a* to the drain bolt 82.

The outputs of the aforesaid sensors are sent to the ECU 16 and based on the inputted outputs, the ECU 16 controls the operation of the outboard motor 10. The ECU 16, the above sensors and the display 30 are interconnected to be able to communicate with each other through, for example, a communication method standardized by the National Marine Electronics Association (NMEA), i.e., through a Controller Area Network (CAN).

To be specific, based on the output of the steering angle sensor 24, the ECU 16 controls the operation of the steering motor 42 to steer the outboard motor 10. Further, based on the output of the lever position sensor 28, etc., the ECU 16 controls the operation of the throttle motor 60 to open and close the throttle valve 56 to regulate a flow rate of intake air, thereby controlling the engine speed, while controlling the operation of the shift motor 76 to operate the shift mechanism 70 to change the shift position.

Thus, an apparatus for controlling the outboard motor 10 according to this embodiment is a DBW (Drive-By-Wire) control apparatus whose operation system (steering wheel 22 and shift lever 26) has no mechanical connection with the outboard motor 10.

Further, the ECU 16 applies predetermined voltage (e.g., 5V) to the conductor 86*a* through the harness 90 and based on the output (conducting current value γ) of the current sensor 104 at that time, detects an amount of wear debris of the gear mechanism 70 deposited at the drain bolt 82.

Figure 7:
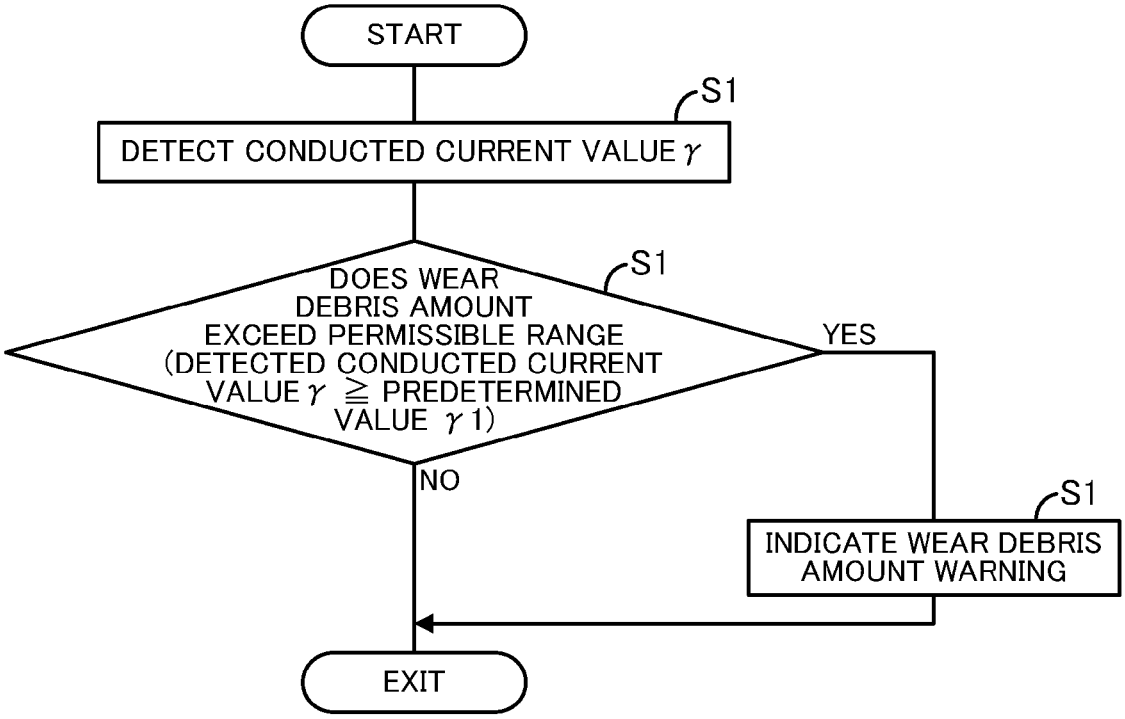
FIG. 7 is a flowchart showing the operation of detecting an amount of wear debris of a gear mechanism, executed by an electronic control unit shown in FIG. 1.

FIG. 7 is a flowchart showing the operation of detecting the amount of the wear debris of the gear mechanism 70. The illustrated program is executed at predetermined intervals (e.g., 100 milliseconds) by the ECU 16.

Before making the explanation on the FIG. 7 flowchart, the operation of detecting the amount of the wear debris will be first explained with reference to FIG. 6. When the driving force of the engine 50 is transmitted to the propeller 74, in the gear mechanism 70, due to the rotating operation, gears are rubbed against each other so that they are worn, sometimes resulting in the wear debris (i.e., metal powder, etc.; indicated by 106 in FIG. 6). After floating in the oil, the wear debris 106 is attracted and adsorbed to the drain bolt 82 comprising the magnetic member and gradually deposited around the stacked portion 86 of the drain bolt 82

Under the condition where the predetermined voltage is applied to the conductor 86*a* as mentioned above, when the wear debris 106 is not deposited at the drain bolt 82 or when a relatively small amount of the wear debris 106 is deposited around the second insulator 86*d* of the stacked portion 86 as indicated by dashed lines, current does not flow from the conductor 86*a* to the drain bolt 82, so that a detected value of the current sensor 104, i.e., the conducting current value γ is to be 0 mA.

Subsequently, when the wear debris 106 is further deposited at the drain bolt 82 and reaches a level of the resistive element 86*c* of the stacked portion 86 as indicated by alternate long and short dashed lines, current flows (or is conducted) from the conductor 86*a*, through the resistive element 86*c* and wear debris 106, to the drain bolt 82 as indicated by alternate long and short dashed line arrows. The conducting current value γ at that time is set to be a relatively low value, e.g., 10 mA or a value slightly greater than 10 mA. Note that the drain bolt 82 is attached to the gear case 64 and it is regarded as being grounded (which is so-called body earth).

Then, when the wear debris 106 is further deposited at the drain bolt 82 and reaches a level of the exposed portion 86*a*1 of the conductor 86*a* of the stacked portion 86 as indicated by alternate long and two short dashed lines, current flows from the conductor 86*a*, through the wear debris 106, to the drain bolt 82 (without flowing through the resistive element 86*c*) as indicated by alternate long and two short dashed line arrows. The conducting current value γ at that time is set to be greater than an electric power value of when the wear debris 106 is deposited to a level of the resistive element 86*c*, e.g., 50 mA or a value slightly greater than 50 mA.

Thus, in this embodiment, the conducting current value γ indicative of current flowing (conducted) from the conductor 86*a* to the drain bolt 82 is changed in accordance with an amount of the wear debris 106 deposited around the stacked portion 86 of the drain bolt 82.

Based on the above premise, the FIG. 7 flowchart will be explained. The program begins at S (Step) 10 in which, based on the output of the current sensor 104, the conducting current value γ indicative of current flowing from the conductor 86*a* to the drain bolt 82 is detected.

Next the program proceeds to S12 in which, based on the detected conducting current value γ, the amount of the wear debris of the gear mechanism 70 deposited around the stacked portion 86 of the drain bolt 82 is detected and it is determined whether the detected amount of the wear debris exceeds the permissible range. Specifically, the detected conducting current value γ is compared to a predetermined value γ1 and when the conducting current value γ is equal to or greater than the predetermined value γ1, the detected amount of the wear debris is determined to exceed the permissible range. In other words, it is determined that the amount of the wear debris is increased and it may be caught in the gear mechanism 70 as obstacles, so that it possibly damages the gear mechanism 70 or causes other troubles. Therefore, it leads to the conclusion that the maintenance of the outboard motor 10 such as oil change, a check of the gear mechanism 70, etc., should be carried out.

Consequently, the predetermined value γ1 is set as a criterion for determining whether the amount of the deposited wear debris of the gear mechanism 70 exceeds the permissible range, i.e., whether the wear debris amount reaches a level of the resistive element 86*c* of the stacked portion 86 of the drain bolt 82 so that the maintenance should be carried out, e.g., set to 10 mA.

When the result in S12 is negative, the remaining steps are skipped, while when the result is affirmative, the program proceeds to S14 in which a fact that the detected amount of the wear debris has exceeded the permissible range is indicated on the display 30 as a wear debris amount warning to inform the operator, so that the operator is prompted to carry out the maintenance of the outboard motor 10.

As stated above, the embodiment is configured to have an outboard motor (10) having a prime mover (engine 50), a gear mechanism (70) adapted to transmit a driving force of the prime mover to a propeller (74), and a gear case (64) housing the gear mechanism, comprising: a drain bolt (82) adapted to be fastened to a drain hole (80) bored at the gear case, the drain bolt being constituted as a magnetic member; a stacked portion (86) provided at an exposed part (82*a*1) of the drain bolt in an inside of the gear case and having a conductor (86*a*), an insulator (first insulator 86*b*) and a resistive element (86*c*) partially making contact with the conductor that are stacked in a gravitational direction; a current detector (ECU 16, current sensor 104, S10) adapted to detect a conducted current value (γ) conducted from the conductor to the drain bolt under a condition where voltage is applied to the conductor; and a wear debris amount detector (ECU 16, S12) adapted to detect an amount of wear debris (106) of the gear mechanism deposited at the drain bolt based on the detected conducted current value.

With this, it becomes possible to detect the amount of the wear debris 106 of the gear mechanism 70 with the simple structure, thereby preventing the gear mechanism 70 from being damaged by the wear debris 106. To be more specific, since the drain bolt 82 comprises the magnetic member, the wear debris 106 generated through rubbing of the gear mechanism 70 is attracted and adsorbed to the drain bolt 82 and gradually deposited around the stacked portion 86 of the drain bolt 82. Under a condition where voltage is applied to the conductor 86*a* of the stacked portion 86, when the wear debris 106 is not deposited, current does not flow from the conductor 86*a* to the drain bolt 82, and when the wear debris 106 is deposited to a level of the resistive element 86*c*, current flows from the conductor 86*a* to the drain bolt 82 through the resistive element 86*c* and wear debris 106. When the wear debris 106 is deposited to exceed a level of the first insulator 86*b* that is positioned higher than the resistive element 86*c* in the gravitational direction and then to a level of the conductor 86*a*, current flows from the conductor 86*a* to the drain bolt 82 through the wear debris 106, in other words, current does not flow through the resistive element 86*c*, so that the conducting current value γ to be conducted to the drain bolt 82 is changed.

Since this embodiment is configured so that the conducting current value γ indicative of current flowing (conducted) from the conductor 86*a* to the drain bolt 82 is changed in accordance with the amount of the wear debris 106 deposited at the drain bolt 82, it becomes possible to detect the amount of the wear debris 106 (i.e., wear status of the gear mechanism 70) with the simple structure. Therefore, the operator can know the amount of the wear debris 106 even during cruising and when, for instance, the detected amount of the wear debris 106 is increased, the maintenance such as oil change, etc., can be carried out at the appropriate timing, thereby preventing the gear mechanism 70 from being damaged by the wear debris 106. Further, since the branch passage and detecting section provided in the reference '730 are not necessary, the outboard motor 10 can avoid becoming larger and more complex.

In the outboard motor, the current detector applies predetermined voltage (5V) to the conductor to detect the conducted current value (S10) and determines that the detected amount of the wear debris exceeds a permissible range when the detected conducted current value is equal to or greater than a predetermined value (γ1).

With this, it becomes possible to easily determine that the amount of the wear debris 106 of the gear mechanism 70 has exceeded the permissible range, more precisely, the amount of the wear debris 106 is increased and the gear mechanism 70 may be damaged so that the maintenance of the outboard motor 10 should be carried out, with the use of the conducting current value γ to be conducted from the conductor 86*a* to the drain bolt 82.

The outboard motor further includes: an informer (ECU 16, display 30, S12, S14) adapted to inform an operator of a fact that the amount of the wear debris has exceeded the permissible range when the fact is determined by the wear debris amount detector. With this, it becomes possible to surely make the operator recognize a fact that the amount of the wear debris 106 has exceeded the permissible range.

In the outboard motor, the conductor has a metal member. With this, it becomes possible to detect the amount of the wear debris 106 of the gear mechanism 70 with the further simpler structure.

It should be noted that, although, in the foregoing, the engine 50 is exemplified as the prime mover, it may be an electric motor or a hybrid of the engine and electric motor.

It should also be noted that, although the outboard motor is taken as an example, this invention can be applied to an inboard/outboard motor. Further, although the predetermined value γ1, the voltage (predetermined voltage) to be applied to the conductor 86*a*, the resistance value of the resistive element 86, displacement of the engine 46 and other values are indicated with specific values in the foregoing, they are only examples and not limited thereto.

Japanese Patent Application No. 2011-255442, filed on Nov. 22, 2011, is incorporated by reference herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An outboard motor having a prime mover, a gear mechanism adapted to transmit a driving force of the prime mover to a propeller, and a gear case housing the gear mechanism, comprising:

a drain bolt adapted to be fastened to a drain hole bored at the gear case, the drain bolt being constituted as a magnetic member;

a stacked portion provided at an exposed part of the drain bolt in an inside of the gear case and having a conductor, an insulator and a resistive element partially making contact with the conductor that are stacked in a gravitational direction;

a current detector adapted to detect a conducted current value conducted from the conductor to the drain bolt under a condition where voltage is applied to the conductor; and a wear debris amount detector adapted to detect an amount of wear debris of the gear mechanism deposited at the drain bolt based on the detected conducted current value.

2. The outboard motor according to claim 1, wherein the current detector applies predetermined voltage to the conductor to detect the conducted current value and determines that the detected amount of the wear debris exceeds a permissible range when the detected conducted current value is equal to or greater than a predetermined value.

3. The outboard motor according to claim 2, further including:

an informer adapted to inform an operator of a fact that the amount of the wear debris has exceeded the permissible range when the fact is determined by the wear debris amount detector.

4. The outboard motor according to claim 1, wherein the conductor has a metal member.

5. A method of detecting wear debris of a gear mechanism adapted to transmit a driving force of a prime mover to a propeller of an outboard motor having a gear case housing the gear mechanism, a drain bolt adapted to be fastened to a drain hole bored at the gear case, the drain bolt being constituted as a magnetic member, and a stacked portion provided at an exposed part of the drain bolt in an inside of the gear case and having a conductor, an insulator and a resistive element partially making contact with the conductor that are stacked in a gravitational direction, comprising the steps of:

detecting a conducted current value conducted from the conductor to the drain bolt under a condition where voltage is applied to the conductor; and detecting an amount of wear debris of the gear mechanism deposited at the drain bolt based on the detected conducted current value.

6. The method according to claim 5, wherein the step of current detecting applies predetermined voltage to the conductor to detect the conducted current value and determines that the detected amount of the wear debris exceeds a permissible range when the detected conducted current value is equal to or greater than a predetermined value.

7. The method according to claim 6, further including the step of:

informing an operator of a fact that the amount of the wear debris has exceeded the permissible range when the fact is determined by the step of wear debris amount detecting.

8. The method according to claim 5, wherein the conductor has a metal member.

* * * * *